United States Patent [19]

DeBruyn, Jr. et al.

[11] Patent Number: 4,690,884

[45] Date of Patent: Sep. 1, 1987

[54] PHOTOGRAPHIC ELEMENT AND METHOD FOR FORMING TRANSPARENCIES

[75] Inventors: Frank E. DeBruyn, Jr., Abington; Lucretia J. Weed, Lexington, both of Mass.

[73] Assignee: Polaroid Corporation, Cambridge, Mass.

[21] Appl. No.: 828,385

[22] Filed: Feb. 11, 1986

[51] Int. Cl.[4] ..... G03C 5/54; G03C 5/26; G03C 5/36; G03C 5/38

[52] U.S. Cl. ..... 430/206; 430/214; 430/227; 430/232; 430/236; 430/244; 430/376; 430/404; 430/420; 430/451; 430/453

[58] Field of Search ..... 430/404, 206, 231, 232, 430/244, 236, 214, 227, 376, 420, 451, 453

[56] References Cited

U.S. PATENT DOCUMENTS

| | | | |
|---|---|---|---|
| 3,647,464 | 3/1972 | Smith et al. | 430/404 |
| 3,689,272 | 9/1972 | Schwan et al. | 430/206 |
| 4,359,518 | 11/1982 | Hanselman et al. | 430/244 |

*Primary Examiner*—Richard L. Schilling
*Attorney, Agent, or Firm*—Philip G. Kiely

[57] ABSTRACT

A scavenger-spreader element adapted for use with a photosensitive element to form a negative image is disclosed as well as methods for processing said photosensitive element to produce the negative image. The scavenger-spreader element comprises a support carrying a hydrophilic layer, a cross-linking agent for the polymeric thickener of the photographic processing composition, a barrier layer to control diffusion of said cross-linking agent and a layer adapted to possess substantial adhesion for the cross-linked polymeric thickening agent.

24 Claims, 5 Drawing Figures

PHOTOGRAPHIC ELEMENT AND METHOD FOR FORMING TRANSPARENCIES

BACKGROUND OF THE INVENTION

Procedures for preparing photographic images in silver by diffusion transfer principles are well known in the art. For the formation of positive silver images, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise suitable silver precipitating layer. The processing composition effects development of the latent image in the emulsion, and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this desription are disclosed, for example, in U.S. Pat. No. 2,543,181 issued to Edwin H. Land. See also Edwin H. Land, One Step Photography, Photographic Journal, Section A, pgs. 7–15, January 1950.

U.S. Pat. No. 3,674,482 issued July 4, 1972, is directed to a silver diffusion transfer film unit which comprises a support carrying on one surface, in order, a layer containing silver precipitating nuclei, an inert non-nuclei-containing protective layer and a layer containing a photosensitive silver halide emulsion. The purpose of the non-nuclei-containing protective layer is to provide a layer over the transferred silver image after the emulsion layer has been removed subsequent to processing which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392 issued Nov. 1, 1977 is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer an increase in $D_{max}$ is achieved with substantially no adverse effect on $D_{min}$ compared to a protective layer composed of chitosan alone.

U.S. Pat. No. 3,677,753, issued July 18, 1972, is directed to a photographic process wherein an exposed and processed film unit of the type decribed in U.S. Pat. No. 3,674,482 is contacted with a revolving roller having a coating thereon to which the photosensitive layer is more adherent than the adjacent layer of the film unit thereby detaching the photosensitive layer from the film unit.

U.S. Pat. No. 4,359,518 issued Nov. 16, 1982 is directed to a method which comprises exposing a diffusion transfer film unit which includes an image-receiving layer and a photosensitive silver halide emulsion layer; disposing a liquid processing composition intermediate a stripping sheet and the outermost layer of the film unit wherein the stripping sheet comprises a support carrying, in order, a water-absorbing layer and a timing layer capable of conversion from substantial liquid processing composition impermeability to a condition of substantial liquid processing composition permeability, whereby said timing layer forms a bond between the outermost layer of the film unit and the stripping sheet, and detaching the stripping sheet and the photosensitive layer of the film unit which has adherred to the stripping sheet from the rest of the film unit.

U.S. Pat. No. 3,930,864 issued Jan. 6, 1976 is directed to a photographic assemblage which employs a scavenger layer capable of immobilizing byproducts of processing reactions which may affect image quality in the image-receiving layer.

U.S. Pat. No. 4,370,045 issued Jan. 25, 1983 is directed to an apparatus for processing an exposed roll of self-developing or instant-type transparency film. One aspect of the invention employs a container of processing liquid and a processing liquid dispenser. In operation, the processing composition flows from the container into the dispenser. Sheet material passes beneath the dispenser acquiring a coating of the processing liquid on the surface thereof. That coated surface is then moved into engagement with the emulsion side of the exposed film and directed between a pair of rollers to form a laminate. After the desired period of processing, the processed film and the sheet are separated with the processed silver halide emulsion layer remaining with the sheet and the film unit now consisting essentially of the positive transparency image.

The above-mentioned patents which employ a stripping step are involved with the removal of the exposed and processed silver halide emulsion layer. The desired product, therefore, consists of a positive silver image. By means of the present invention, a negative image of enhanced quality is obtained.

SUMMARY OF THE INVENTION

The present invention is directed to a method for obtaining a negative image of enhanced quality. The present invention comprises a method of exposing a photosensitive element of the self-developing type comprising a photosensitive silver halide emulsion layer, processing the exposed element by the application of an aqueous alkaline photographic processing composition comprising a polymeric thickening agent, by superposing a scavenger-spreader element over the photosensitive element and in contact with the photographic processing composition. A silver halide developing agent and a silver halide solvent may be disposed in the processing composition or in the photosensitive element. The scavenger-spreader element comprises a support carrying a layer of a hydrophilic polymer, a cross-linking agent for the polymeric thickener, a barrier layer to control diffusion of the cross-linking agent and a layer adapted to possess substantial adhesion for cross-linked polymeric thickening agent. In a preferred embodiment, the scavenger-spreader element also includes silver precipitating nuclei. Subsequent to processing, unwanted by-products produced during the processing diffuse to the scavenger-spreader element and the cross-linking agent diffuses into the polymeric thickener. The polymeric thickener exhibits a greater adhesion for the scavenger-spreader element than for the photosensitive element and, upon separation of the scavenger-spreader element from the processed photosensitive element, the unwanted by-products and the excess processing composition would also be removed from the processed photosensitive element leaving the desired negative image.

DETAILED DESCRIPTION OF THE INVENTION

Figure 1:
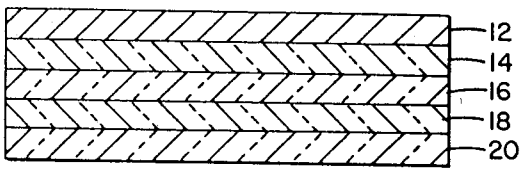
FIG. 1 is a cross-sectional drawing of a preferred scavenger-spreader layer of the present invention.

As described in the Background of the Invention, in the formation of instant positive transparency images, it is desirable to remove the silver halide emulsion layer from association with the positive image subsequent to processing. The advantages of the removal of this layer reside in decreased densities in the $D_{min}$ region and enhanced stability of the image as a result of the removal of residual processing composition and other unwanted by-products of the development process which may be detrimental to the image quality and long-term stability of the image.

The present invention is concerned with the formation of a negative image in the photosensitive element and would not be considered a diffusion transfer process in that the imaging material does not migrate or diffuse to an image-receiving layer but rather is retained in the photosensitive element. However, the unwanted by-products of the processing operation are removed by diffusion to the superposed scavenger-spreader element. For example, in a preferred embodiment, to provide for the removal of undeveloped silver halide, the processing composition includes a silver halide solvent and the scavenger-spreader element includes silver precipitating nuclei to immobilize the diffusing silver halide by means of a physical development reaction which also consumes other excess reactants. To further insure the efficient removal of undesirable materials from the thus-formed negative image, the processing composition employs a polymeric thickening material which is cross-linked by a cross-linking agent which diffuses from the scavenger-spreader element. The polymeric thickening agent and the material of the outermost layer of the scavenger-spreader element are selected to provide a greater adhesion for each other than the polymeric thickener would have for the photosensitive element. Upon separation of the two elements, the processing composition preferentially adheres to the scavenger-spreader element. The cross-linking agent converts the processing composition into a rubbery, cohesive layer, providing sufficient strength and integrity so that it doesn't break apart during separation of the elements. Cross-linking may also promote adhesion to the scavenger-spreader layer.

The scavenger-spreader element of the present invention comprises a support carrying on a first surface a hydrophilic polymer, a cross-linking agent for the processing composition polymeric thickening agent, a barrier layer to prevent premature contact of the cross-linking agent with the polymeric thickening agent and a layer adapted to exhibit substantial adhesion to the cross-linked polymeric thickening agent.

In its simplest form, the scavenger-spreader layer consists of a support carrying, in order, a hydrophilic layer, having a cross-linking agent disposed therein and a polymeric barrier layer wherein the barrier layer provides the time delay for the cross-linking agent to contact the polymeric thickening agent, and a layer adapted to possess substantial adhesion for the cross-linked polymeric thickening agent. Preferably, the barrier layer contains silver precipitating nuclei disposed therein.

Alternatively, the silver precipitating nuclei may be disposed in the hydrophilic layer, but more efficient removal of the dissolved silver halide is achieved with the silver precipitating nuclei in the outermost layer of the element.

The function of the hydrophilic layer is to absorb the liquid processing composition. Preferably, this absorbing capability is also possessed by the barrier layer. As examples of suitable hydrophilic materials for use in the hydrophilic layer of the present invention mention may be made of natural and synthetic swellable materials, including paper, absorptive, open-cell foam sponges, polymers and copolymers and combinations thereof. Preferred are polymers such as polyvinyl alcohol, hydroxyethyl cellulose, sodium carboxymethyl cellulose and derivatized starch. Particularly preferred is gelatin.

It should be understood that the barrier layer for the cross-linking agent is not a barrier to the diffusion of the by-products or other materials diffusing from the photosensitive element. The function of the barrier layer is to hold up the diffusion of the cross-linking agent for a predetermined time to avoid premature cross-linking of the polymeric thickener. For example, in the film processor described above in U.S. Pat. No. 4,370,045, the scavenger-spreading sheet would be in contact with the processing composition for a given period of time prior to lamination with the photosensitive element as the dispenser is filled. If the cross-linking agent were prematurely available to the polymeric thickener, cross-linking would occur before proper spreading of the processing composition had occurred resulting in physical defects in the finished product and/or an improperly processed product.

The barrier layer and the layer adapted to possess substantial adhesion for the cross-linked polymeric thickening agent can be separate materials and/or layers. In a preferred embodiment, the outermost layer of the element functions at both the barrier layer for the cross-linking agent and as the material possessing preferential adhesion for the cross-linked polymeric thickening agent. As stated above, more efficient immobilization of diffusing silver halide is achieved by employing silver precipitating nuclei, preferably in the outermost layer. Thus, in a particularly preferred embodiment, the barrier layer also contains silver precipitating nuclei.

Employing the novel scavenger-spreader layer of the present invention obviates the necessity of a release coat over the photosensitive element which is usually used in the art.

It will be seen that the barrier layer, the cross-linking agent, the polymeric thickening agent and the layer having substantial adhesion for the cross-linked polymeric thickening agent each must be selected giving consideration to the other materials since co-action of all these materials must occur to provide the desired result. As examples of suitable materials, mention may be made of thickener/cross-linker combinations such as carboxymethyl cellulose or carboxymethyl hydroxyethyl cellulose with multivalent alkali-soluble metal ions such as lead, tin, zirconium and zinc ions; hydroxyethyl cellulose with chromium and kappa carrageenan or sodium cellulose sulfate with multivalent metal ions or monovalent metal ions such as potassium or cesium.

Suitable barrier layers include chitosan, propylene glycol alginate and alginic acid, as well as mixtures of the above-named polymers with alkali-swellable polymers, such as gelatin, polyacrylamide, and polyethylene oxides. The materials described above as suitable for use as thickeners may also be employed as barrier layers. As examples of materials for use as the outermost layer of the scavenger-spreader layer to which the polymeric thickening agent possesses preferential adhesion, mention may be made of algin derivatives, such as propylene glycol alginate, alginic acid and sodium alginate; chitosan; and mixtures with an alkali-swellable polymer. It will been seen that the outermost layer of the scavenger-spreader layer may be composed of the same material as the polymeric thickening agent.

In a particularly preferred embodiment, the scavenger-spreader layer also employs pH reducing means, i.e., an acid functioning layer adapted to reduce the alkaline pH of the element and further stabilize the element containing the negative image subsequent to substantial image formation. In the event that dyes employed in the present invention are pH sensitive, the acid layer functions to shift the color to its final state thus avoiding color changes during aging. In order to avoid premature reduction of the pH a timing layer is employed over the acid layer. Thus, the timing layer provides a predetermined time delay after the alkali of the processing composition contacts it before sufficient penetration occurs to release the acid component and effectuate pH drop. The acid layer may comprise any suitable acid-reacting material, for example, such as those disclosed in U.S. Pat. No. 3,362,819, issued Jan. 9, 1968. The acid-reacting reagents are preferably polymers which contain acid groups, e.g., carboxylic acid and sulfonic acid groups which are capable of forming salts with alkali metals or with organic bases or potentially acid-yielding groups such as anhydrides or lactones. Preferably, the acid polymer contains free carboxyl groups. As examples of useful neutralizing layers, in addition to those dislosed in the aforementioned U.S. Pat. No. 3,362,819, mention may be made of those disclosed in the following U.S. Pat. Nos.: 3,362,819; 3,765,885; 3,819,371; 3,833,367; and 3,756,815.

As examples of suitable timing layers, reference may be made to U.S. Pat. Nos. 3,362,819; 3,419,389; 3,421,893; 3,433,633; 3,455,686; 3,575,701; 3,785,815 and 3,856,522.

It has been advantageously found that the combination of a barrier layer comprised of an algin derivative, a polymeric thickening agent comprised of carboxymethyl cellulose and a cross-linking agent for the thickener, such as lead and zinc salts, e.g., lead acetate and zinc acetate, provides particularly desirable results. Processing a photosensitive element with a scavenger-spreader layer containing these components provides not only efficient removal of the unwanted by-products of the processing but also results in adequate time delay in the cross-linking of the carboxymethyl cellulose and adhesion of the cross-linked carboxymethyl cellulose to the algin layer resulting in a clean and substantially complete removal of the processing composition layer from the processed photosensitive element. Suitable algin derivatives include sodium alginate and propylene glycol alginate.

While not intending to be bound by theory, it is believed that the algin derivative, upon contact with the alkali of the photographic processing composition, converts to a salt of alginic acid and that the diffusing heavy metal cross-linking agent reacts therewith and is bound thereto. When all the reaction sites for the zinc and lead are used up the cross-linkers can then pass through the barrier layer and cross-link the carboxymethyl cellulose, which, in its cross-linked state, possesses a substantial and preferential degree of adhesion to the algin layer.

The photosensitive element comprises a support carrying a photosensitive silver halide emulsion layer. Exposure and processing according to the procedure of the present invention will produce a negative transparency black and white image in silver. In a preferred embodiment, the photosensitive element also includes a diffusible dye-forming coupler and a dye image is formed in the photosensitive element by coupler chemistry. Coupler chemistry is well-known to the art and employs a developer which includes a color developing agent such as a primary aromatic amine which in its oxidized form is capable of reacting with the coupler to form the image dye which is essentially immobile. For additional information on coupler chemistry, reference may be made to Research Disclosure, January, 1983, No. 22534.

In a particularly preferred embodiment, the photosensitive element also includes a layer of fine-grain, unsensitized silver halide. Preferably, up to about 60% of the silver halide of the photosensitive silver halide emulsion is replaced with unsensitized silver halide. The unsensitized silver halide may be incorporated in the same layer as the sensitized emulsion or in a separate layer above or below the sensitized emulsion. Preferably, the unsensitized silver halide is disposed above the sensitized emulsion, i.e., with the sensitized emulsion layer between the unsensitized silver halide and the support. The term "unsensitized silver halide" as used herein is intended to refer to silver halide which will not form an image under the conditions of exposure and development employed herein. The grain size of the unsensitized silver halide preferably ranges from about 0.02 to 0.5.

The employment in the photosensitive element of the sensitized emulsion and unsensitized silver halide results in an image having $D_{max}$ and $D_{min}$ values similar to that obtained if only the sensitized emulsion were employed. However, in a color element the combination provides greater contrast and a silver image of lower covering power and, therefore, greater color purity in the dye image. While not intending to be bound by theory, it is believed that the mechanism involves the dissolution by the silver halide solvent of the small, unsensitized grains which then can deposit additional silver through physical development onto the filaments of already developed silver from the exposed, sensitized grains. Due to the exposure related timing of the development of the sensitized grains, this supplemental deposition is greater at higher exposure than at lower exposure, thus providing higher contrast in the dye image. Since the deposition of silver from the unsensitzied grains merely thickens the filaments from the exposed, sensitized grains without adding new ones, the silver image is of low covering power. A bleaching step, which would be required in prior art systems to eliminate the silver image, is not required in the present invention. In areas of low exposure, the silver halide solvent serves to fix out all unreacted silver halide, allowing it to diffuse to the scavenger-spreader sheet. Where the scavenger-spreader element employs silver precipitating nuclei the diffusing silver halide is deposited on the nuclei through physical dvelopment. Excess developer and coupler and other unwanted by-products are also consumed in the scavenger-spreader element which is then detached from the photosensitive element.

The process of the present invention accordingly comprises exposing a photosensitive element, processing said photosensitive element by the application of a layer of photographic processing composition, laminating a scavenger-spreader element thereto and separating the photosensitive element and scavenger-spreader element subsequent to substantial image formation in the photosensitive element. In its broadest sense, the invention comprises exposing a photosensitive element including a photosensitive silver halide emulsion layer, processing said exposed photosensitive element by the application of an aqueous alkaline photographic processing composition comprising a polymeric thickening agent, and, optionally, a silver halide developing agent and a silver halide solvent, superposing a second element comprising a layer of hydrophilic polymer, preferably a layer of silver precipitating nuclei and a cross-linking agent for said polymeric thickener, whereby unwanted by-products produced during processing of said photosensitive element diffuse to said second element and the cross-linked polymeric thickener exhibits greater adhesion for said second element then said photosensitive element, and detaching said second element and adherred cross-linked polymeric thickener from said processed photosensitive element to provide a negative image in the photosensitive element and, by employing coupler chemistry, a colored negative image of enhanced quality. As stated above, the silver halide developing agent and silver halide solvent may be disposed in the photosensitive element instead of the processing composition.

Application of the processing composition to the exposed photosensitive element is preferably carried out by first applying a layer of processing composition to the surface of the scavenger-spreader element and then laminating the two elements together.

Turning now to the drawings, FIG. 1 is a cross-sectional view of a preferred scavenger-spreader element 10 of the present invention which consists of support 12 which may be transparent or opaque, polymeric acid layer 14, timing layer 16, hydrophilic polymer layer 18, e.g., gelatin, containing cross-linking agent for the processing composition and barrier layer 20, which controls the diffusion of cross-linking agent and to which the cross-linked polymeric thickener of the processing composition possesses preferential adhesion and which contains silver precipitating nuclei.

Figure 2:
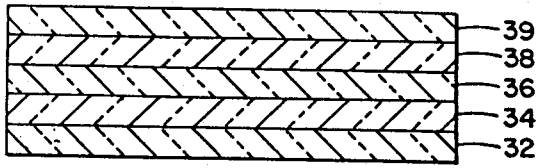
FIG. 2 is a cross-sectional drawing of a preferred photosensitive element for use in the present invention.

FIG. 2 is a cross-sectional view of photosensitive element 30 which comprises transparent support 32, antihalation layer 34, photosensitive silver halide emulsion layer 36, layer 38 containing dye-forming coupler and unsensitized silver halide and antiabrasion layer 39.

Figure 3:
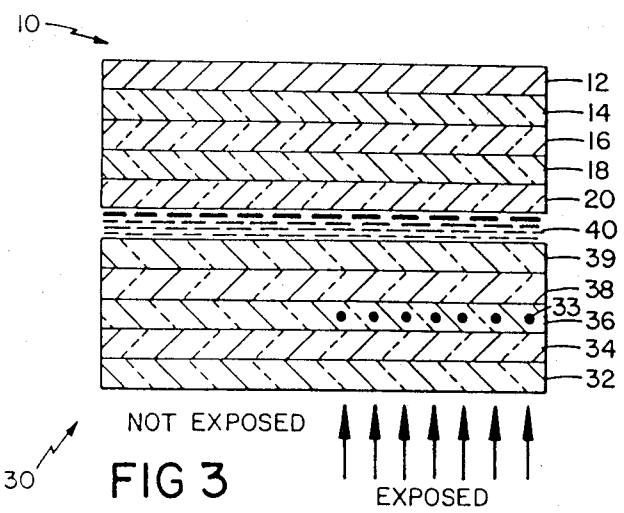
FIG. 3 is a cross-sectional drawing showing the lamination of a scavenger-spreader layer to an exposed photosensitive element during processing.
Figure 4:
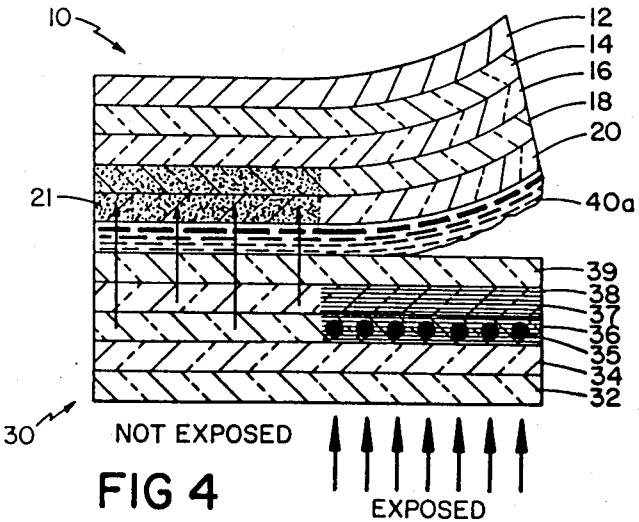
FIG. 4 shows the processed lamination of FIG. 3 with the scavenger-spreader element partly detached.

FIG. 3 is a cross-sectional view of exposed photosensitive element 30 shown in FIG. 2, laminated to scavenger-spreader layer 10 shown in FIG. 1 with a layer of processing composition 40 disposed therebetween. The arrows below photosensitive element 30 indicate areas of exposure with the exposed silver halide grains 33 depicted in emulsion 36. As processing proceeds, as seen in FIG. 4, the exposed silver halide 33 is developed as indicated at 35 and reacts with coupler to form a dye image as indicated by area 37. In the unexposed areas, the unwanted by-products including dissolved silver and unreacted coupler diffuse along the path indicated by the arrow to scavenger-spreader element 10 whereby such by-products are deposited in layers 18 and 20 as indicated by cross-hatching 21. Scavenger-spreader element 10 and cross-linked processing composition **40*a* are shown partly peeled from photosensitive element 30** which now contains the finished image.

The following non-limiting example illustrates the novel method of the present invention.

EXAMPLE

Photosensitive Element

The photosensitive element was prepared by coating a transparent 4 mil polyester base having a transmission density of about 0.1 with the following layers, in sequence.

1. An antihalation layer comprising 89.4 mg/m$^2$ of a yellow dye, 5.6 mg/m$^2$ of a magenta dye and 11.0 mg/m$^2$ of sodium cellulose sulfate;

2. a gelatino-silver halide emulsion layer comprising 800 mg/m$^2$ of gelatin, 384 mg/m$^2$ of 0.75 micrometer (0.11 coefficient of variation) ortho sensitized silver bromide grains, 192 mg/m$^2$ of carboxylated styrene/-butadiene copolymer latex and 5.6 mg/m$^2$ of polyvinyl hydrogen phthalate;

3. a coupler layer comprising 943 mg/m$^2$ of tricresyl phosphate, 825 mg/m$^2$ of gelatin, 754 mg/m$^2$ of 4-chloro-1-naphthol (blue coupler), 450 mg/m$^2$ of primitive silver bromide (0.17 micrometer), 62.8 mg/m$^2$ isopropylnaphthalene sulfonic acid, sodium salt, 36.4 mg/m$^2$ of p-nitrophenylacetonitrile (magenta coupler) and 11.3 mg/m$^2$ of polyvinyl hydrogen phthalate;

4. an anti-abrasion layer comprising 800 mg/m$^2$ of gelatin, 53.3 mg/m$^2$ of fluorocarbon surfactant (sold by E. I. du Pont de Nemours, Inc. Wilmington Del. under the tradename ZONYL FSN), 17 mg/m$^2$ of polyvinyl hydrogen phthalate, 10.8 mg/m$^2$ of silica microspheres (1–5 micrometers), and 6.7 mg/m$^2$ of 4-chloro-3,5-dimethylphenol;

5. an overcoat layer comprising 107 mg/m$^2$ of succindialdehyde and 18.3 mg/m$^2$ of fluorocarbon surfactant.

Scavenger-spreader Element

The scavenger-spreader element was prepared by coating a 4 mil polyester base with the following layers, in sequence:

1. a polymeric acid layer comprising a 4/1/5 emulsion terpolymer of methacrylic acid, acrylic acid and butyl acrylate coated at a coverage of about 16,140 mg/m$^2$;

2. a timing layer comprising a 40/40/18/2 tetrapolymer of butyl acrylate/diacetone acrylamide/carbomethoxymethyl acryate/acrylic acid coated at a coverage of about 2000 mg/m$^2$;

3. a layer comprising about 10,760 mg/m$^2$ of gelatin, 1076 mg/m$^2$ of lead acetate and about 1076 mg/m$^2$ of zinc acetate;

4. an outermost layer comprising 430 mg/m$^2$ of propylene glycol alginate and palladium nuclei at a coverage of about 2.8 mg/m$^2$ of palladium.

| Processing Composition | Weight percent |
|---|---|
| Water | 85.3 |
| Carboxymethyl cellulose | 3.13 |
| Lithium hydroxide | 4.21 |
| Sodium sulfite | 1.04 |
| Sodium thiosulfate | 1.72 |
| Benzotriazole | 0.13 |
| 4-hydroxymethyl-4-methyl-1-phenyl-3-pyrazolidone | 0.18 |
| N—ethyl-N—(2-methanesulfonamidoethyl)-2-methyl-1,4-phenylene diamine (sesquisulfate, monohydrate) | 3.58 |
| N—alkyl trimethyl ammonium chloride (ARQUAD 12-33 sold by Armak Ind. Chem. Div., Chicago, IL) | 0.66 |

Figure 5:
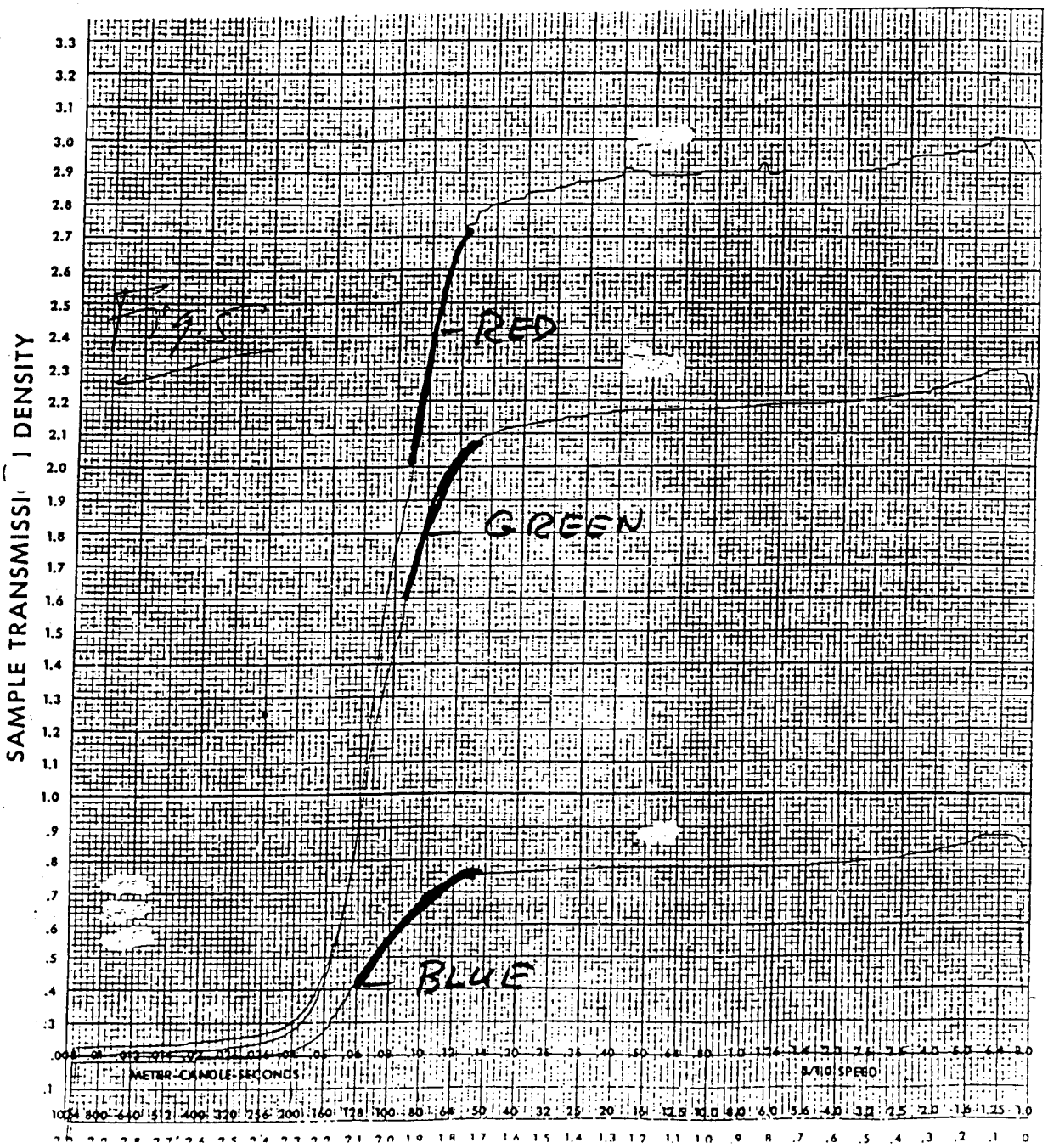
FIG. 5 is a characteristic curve of the film unit of the present invention.

The photosensitive element was exposed at 104 mcs to a xenon flash. The Processing Composition was coated on the Scavenger-Spreader element at a coverage of about 46.3 g/m$^2$ which was then laminated in the dark to the exposed Photosensitive Element. After 3 min. the Scavenger-Spreader Element was stripped from the Photosensitive Element. Inspection of the Photosensitive Element showed no retention of Processing Composition. FIG. 5 is a characteristic Curve of the thus-obtained transparency image obtained by reading the neutral column to red, green and blue light in an automatically recording densitometer.

The term "unwanted by-products" as used herein is intended to refer to excess or unwanted components of the film unit or processing composition, by-products of the processing reactions, including, but not limited to, undeveloped silver halide, dissolved silver ion, unreacted coupler and unreacted developer.

Silver halide solvents useful in forming the desired soluble complex with unexposed silver are well known and, for example, may be selected from the alkali metal thiosulfates, particularly sodium or potassium thiosulfates, or the silver halide solvent may be cyclic amide, such as uracil, in combination with a nitrogenous base as taught in U.S. Pat. No. 2,857,274 issued Oct. 21, 1958 to Edwin H. Land, or pseudouracils, such as the 4,6-dihydroxypyrimidines as taught in U.S. Pat. No. 4,126,459, issued Nov. 21, 1978. While the silver halide solvent is preferably initially present in the processing composition, it is within the scope of this invention to initially position the silver halide solvent in a layer of the film unit or the scavenger-spreader sheet, preferably in the form of a precursor which releases or generates the silver halide solvent upon contact with an alkaline processing fluid.

The silver halide developing agents employed in the present invention are of the phenylene diamine type. As examples of suitable developing agents, mention may be made of the following.

N-ethyl-N-(2-methansulfonamidoethyl)-2-methyl-1,4-phenylenediamine (sesquisulfate, monohydrate)

N,N-diethyl-2-methyl-1,4-phenylenediamine (hydrochloride)

N,N-diethyl-1,4-phenylenediamine (hydrochloride)

N-ethyl-N-(2-hydroxyethyl)-1,4-phenylenediamine (sulfate, monohydrate)

N,N-diethyl-1,4-phenylenediamine (sulfate)

N-ethyl-N-(2-hydroxyethyl)-2-methyl-1,4-phenylenediamine (sulfate)

The supports employed in the present invention are not critical. The support or film base employed may comprise any of the various types of rigid or flexible supports. For example, glass, polymeric films of both the synthetic type and those derived from natural occurring products, including paper, may be employed. Preferably, a transparent support is employed. Especially suitable materials comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate propionate; polycarbonates; polystyrenes and the like.

What is claimed is:

1. A scavenger-spreading element for use with a photosensitive element adapted to remove unwanted by-products produced during processing of said photosensitive element with a processing composition containing a polymeric thickening agent, which comprises a support carrying a layer of a hydrophilic polymer, a cross-linking agent for said polymeric thickening agent, a barrier layer adapted to provide a temporary delay in the diffusion of said cross-linking agent pH reducing means, and a layer adapted to exhibit subtantial adhesion to cross-linked polymeric thickening agent.

2. The element of claim 1 which includes silver precipitating nuclei.

3. The element of claim 1 in which includes a timing layer to prevent premature release of said pH reducing means.

4. The element of claim 1 wherein said barrier layer is adapted to exhibit substantial adhesion to cross-linked polymeric thickening layer.

5. The element of claim 1 wherein said hydrophilic layer comprises gelatin.

6. The element of claim 5 wherein said gelatin layer contains said cross-linking agent.

7. The element of claim 1 wherein said polymeric thickening agent is carboxymethyl cellulose, said cross-linking agent comprises at least a first heavy metal and said barrier layer comprises an algin derivative.

8. The element of claim 7 wherein said heavy metal salts include lead and zinc.

9. The element of claim 7 wherein said algin derivative is sodium alginate.

10. The element of claim 7 wherein said algin derivative is propylene glycol alginate.

11. A method for forming a negative image which comprises exposing a photosensitive element including a photosensitive silver halide emulsion layer, processing said exposed photosensitive element by the application of an aqueous alkaline photographic processing composition comprising a polymeric thickening agent, laminating a scavenger-spreader element to said photosensitive element, said scavenger-spreader element comprising a layer of hydrophilic polymer, and a cross-linking agent for said polymeric thickener, a barrier layer adapted to provide a temporary delay in the diffusion of said cross linking agent, whereby unwanted by-products produced during processing of said photosensitive element diffuse to said scavenger-spreader element and the polymeric thickener exhibits greater adhesion for said scavenger-spreader element then said photosensitive element, and detaching said scavenger-spreader element and adherred cross-linked polymeric thickener from said processed photosensitive element.

12. The method of claim 11 wherein said processing composition contains a silver halide developing agent and a silver halide solvent.

13. The method of claim 11 wherein said photosensitive element contains a non-diffusing dye-forming coupler.

14. The method of claim 13 wherein said photosensitive element includes a layer of substantially non-sensitive silver halide.

15. The method of claim 11 wherein said photographic processing composition is applied to said scavenger-spreader element prior to lamination to said photosensitive element.

16. The method of claim 11 wherein said scavenger-spreader layer comprises a support carrying a layer of a hyrophilic polymer, a cross-linking agent for said polymeric thickening agent, a barrier layer adapted to provide a temporary delay in the diffusion of said cross-linking agent, silver precipitating nuclei and a layer adapted to exhibit substantial adhesion to cross-linked polymeric thickening agent.

17. The method of claim 11 which includes the step of reducing the pH of said photosensitive element subsequent to substantial image formation.

18. The method of claim 16 wherein said barrier layer is adapted to exhibit substantial adhesion to said polymeric thickening layer.

19. The method of claim 11 wherein said hydrophilic layer comprises gelatin.

20. The method of claim 19 wherein said gelatin layer contains said cross-linking agent.

21. The method of claim 11 wherein said polymeric thickening agent is carboxymethyl cellulose, said cross-linking agent comprises at least a first heavy metal ion and said barrier layer comprises an algin derivative.

22. The method of claim 21 wherein said heavy metal ions include lead and zinc.

23. The method of claim 21 wherein said algin derivative is sodium alginate.

24. The method of claim 21 wherein said algin derivative is propylene glycol alginate.

* * * * *